US006261338B1

(12) United States Patent
Mahoney et al.

(10) Patent No.: US 6,261,338 B1
(45) Date of Patent: Jul. 17, 2001

(54) GAS AND POWDER DELIVERY SYSTEM AND METHOD OF USE

(75) Inventors: William John Mahoney, Dobbs Ferry; John Erling Anderson, Somers, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/414,852

(22) Filed: Oct. 12, 1999

(51) Int. Cl.[7] ..... C21C 5/32

(52) U.S. Cl. ..... 75/414; 75/531; 266/222; 266/225

(58) Field of Search ..... 266/225, 222; 75/414, 531

(56) References Cited

U.S. PATENT DOCUMENTS

| | | | | |
|---|---|---|---|---|
| 3,427,151 | | 2/1969 | Koudelka et al. | 75/59 |
| 4,293,123 | | 10/1981 | Sauert | 266/268 |
| 4,426,224 | | 1/1984 | Shimme et al. | 75/49 |
| 4,857,104 | | 8/1989 | Victorovich et al. | 75/21 |
| 5,366,537 | | 11/1994 | Schlichting | 75/528 |
| 5,714,113 | | 2/1998 | Gittman et al. | 266/182 |
| 5,814,125 | | 9/1998 | Anderson et al. | 75/414 |
| 5,823,762 | | 10/1998 | Anderson et al. | 431/8 |
| 5,931,985 | * | 8/1999 | Schoeler et al. | 75/414 |
| 6,096,261 | * | 8/2000 | Anderson et al. | 266/225 |

FOREIGN PATENT DOCUMENTS

| | | |
|---|---|---|
| 866139 | 9/1998 | (EP) . |
| 874194 | 10/1998 | (EP) . |

* cited by examiner

*Primary Examiner*—Melvyn Andrews
(74) *Attorney, Agent, or Firm*—Stanley Ktorides

(57) ABSTRACT

An arrangement wherein a coherent jet is established proximate to a powder injection system and the coherent jet not only provides for gas delivery but also serves to improve the efficiency of the delivery of powder from the powder injection system.

9 Claims, 2 Drawing Sheets

GAS AND POWDER DELIVERY SYSTEM AND METHOD OF USE

TECHNICAL FIELD

This invention relates generally to coherent jet technology and also to powder injection.

BACKGROUND ART

A recent significant advancement in the field of gas dynamics is the development of coherent jet technology which produces a laser-like jet of gas which can travel a long distance while still retaining substantially all of its initial velocity and with very little increase to its jet diameter. One very important commercial use of coherent jet technology is for the introduction of gas into liquid, such as molten metal, whereby the gas lance may be spaced a large distance from the surface of the liquid, enabling safer operation as well as more efficient operation because much more of the gas penetrates into the liquid than is possible with conventional practice where much of the gas deflects off the surface of the liquid and does not enter the liquid.

Often in the practice of industrial processes such as metal refining, it is desired to inject powder into the liquid, e.g. molten metal. Such powder injection can be from either below or above the liquid surface, although above-surface injection is generally preferred because it is inherently easier and generally also safer. Typically above-surface powder injection is practiced by entraining powder into a carrier gas and providing the carrier gas from an injector device into the liquid. Where coherent jet technology is employed to provide gas into a liquid, powder injection may also be practiced using the known powder injector device.

It would be desirable to use the same lance to generate the coherent gas jet and also for practice of powder injection. However such a system is not a straightforward combination of the two systems because the proximate practice of these two technologies can have a detrimental effect to the efficacy of each.

Accordingly it is an object of this invention to provide a system whereby a single lance may be effectively used to practice coherent jet technology for gas injection into a liquid, and also to practice powder injection for the provision of powder into the liquid.

SUMMARY OF THE INVENTION

The above and other objects, which will become apparent to those skilled in the art upon a reading of this disclosure, are attained by the present invention, one aspect of which is:

A method for delivering both powder and gas to a liquid comprising:

(A) ejecting gas from a lance through a gas opening on the face of the lance to form a gas stream;

(B) ejecting a mixture of powder and carrier gas from the lance through a powder mixture opening on the face of the lance, said powder mixture opening being spaced from the gas opening, to form a powder mixture stream;

(C) forming a flame envelope around both the gas stream and the powder mixture stream; and (D) passing the gas stream and the powder mixture stream from the lance face to the liquid.

Another aspect of this invention is:

Apparatus for providing both powder and gas to a liquid comprising:

(A) a lance having a lance face;

(B) a gas passage within the lance, said gas passage communicating with a source of gas and also communicating with a gas opening on the lance face;

(C) a powder mixture passage within the lance, said powder mixture passage communicating with a source of powder and carrier gas and also communicating with a powder mixture opening on the lance face, said powder mixture opening being spaced from the gas opening; and (D) means for providing gaseous fuel and oxidant out from the lance in a ring around the gas opening and the powder mixture opening.

As used herein the term "coherent jet" means a gas jet which is formed by ejecting gas from a nozzle and which has a velocity and momentum profile along its length which is similar to its velocity and momentum profile upon ejection from the nozzle.

As used herein the term "annular" means in the form of a ring.

As used herein the term "flame envelope" means an annular combusting stream substantially coaxial with at least one gas stream.

As used herein the term "length" when referring to a coherent gas jet means the distance from the nozzle from which the gas is ejected to the intended impact point of the coherent gas jet or to where the gas jet ceases to be coherent.

DETAILED DESCRIPTION

The invention will be described in detail with reference to the Drawings.

Figure 1:
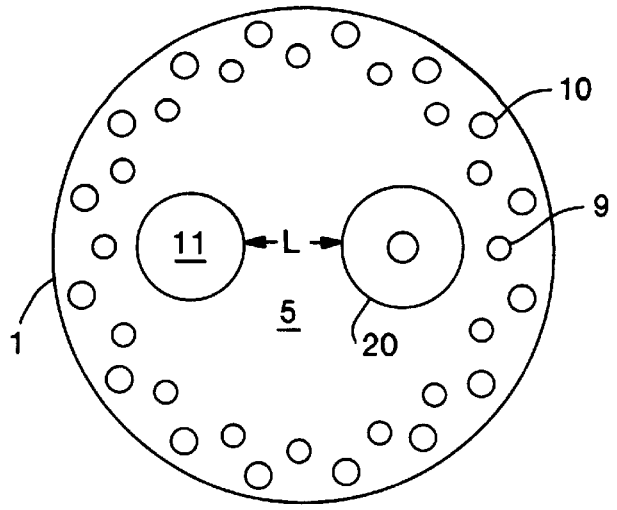
FIG. 1 is a head on view of one embodiment of a lance face.
Figure 2:
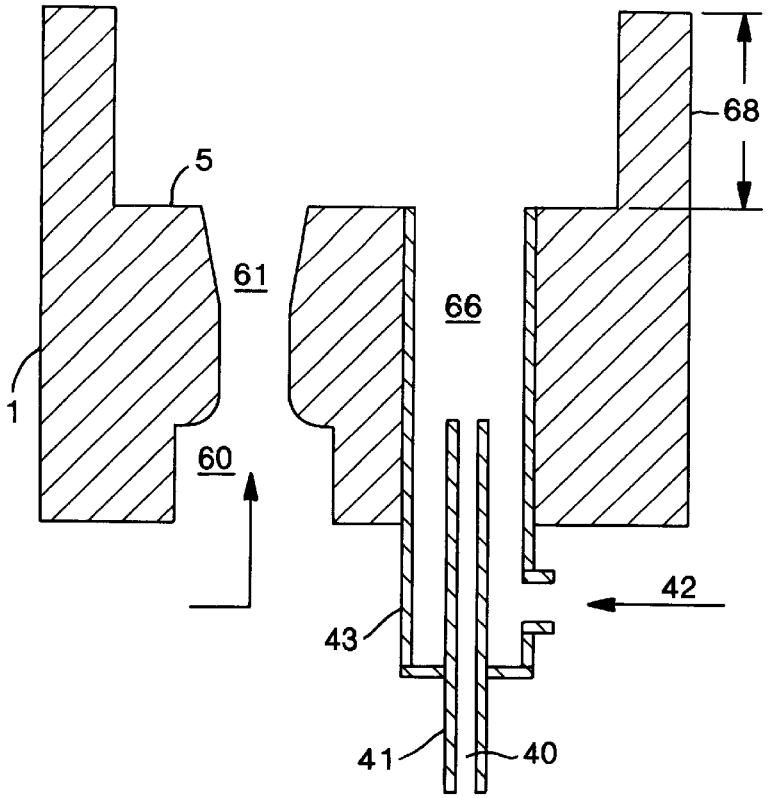
FIG. 2 is a cross sectional of one embodiment of a lance having such lance face which may be used in the practice of this invention.
Figure 3:
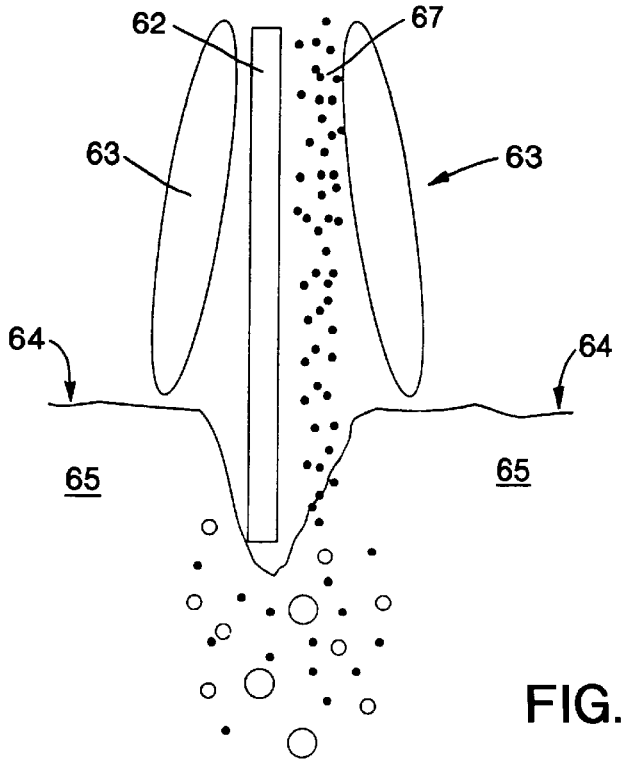
FIG. 3 illustrates one embodiment of the invention in operation showing the various flow streams and the passage into the liquid. The numerals in the Drawings are the same for the common elements

Referring now to FIGS. 1, 2 and 3, gas is passed thorough a gas passage 60 of a lance 1, then through a nozzle 61, preferably a converging/diverging nozzle, and then out from lance 1 through gas opening 11 to form a coherent gas jet stream 62. Typically the velocity of the gas stream is within the range of from 1000 to 8000 feet per second (fps). Preferably the velocity of the gas stream is supersonic when it is formed upon ejection from the lance face and also when it contacts the liquid.

Any effective gas may be used as the gas in the practice of this invention. Among such gases one can name oxygen, nitrogen, argon, carbon dioxide, hydrogen, helium, steam and hydrocarbon gases. Also mixtures comprising two or more gases, e.g. air, may be used as the gas in the practice of this invention. A particularly useful gas for use as the gas in the practice of this invention is gaseous oxygen which may be defined as a fluid having an oxygen concentration of at least 25 mole percent.

Gaseous fuel, such as methane or natural gas, is provided through lance 1 in a gaseous fuel passage which is radially spaced from the gas passage. The gaseous fuel passes out from lance 1 preferably at the lance face 5, as shown in FIG. 1, through a ring of holes 9 around gas opening 11. The gaseous fuel is provided out from lance 1 at a velocity which is preferably less than the velocity of the gas and generally within the range of from 100 to 1000 fps. The gaseous fuel useful in the practice of this invention may also include atomized liquids and powdered material such as pulverized coal entrained in a gas.

The gaseous fuel combusts with oxidant to form a flame envelope 63 around and along the gas stream, preferably for the entire length of the coherent jet 62. The oxidant may be air, oxygen-enriched air having an oxygen concentration exceeding that of air, or commercial oxygen having an oxygen concentration of at least 99 mole percent. Preferably the oxidant is a fluid having an oxygen concentration of at least 25 mole percent. The oxidant may be provided for combustion with the gaseous fuel in any effective manner. One preferred arrangement, which is illustrated in FIG. 1, involves providing the oxidant through a passage within lance 1 and then out from lance 1 through a ring of holes 10 around gas opening 11, preferably further spaced from gas opening 11 than is ring of holes 9. This results in the gaseous fuel and the oxidant interacting and combusting to form the flame envelope 63 upon their respective ejections out from lance 1.

The flame envelope 63 around the main gas stream serves to keep ambient gas from being drawn into the gas stream 62, thereby keeping the velocity of the gas stream 62 from significantly decreasing and keeping the diameter of the gas stream 62 from significantly increasing, for the desired length of the gas stream until the gas stream reaches the desired impact point, such as the surface 64 of a pool of molten metal 65. That is, the flame envelope serves to establish and maintain the gas stream 62 as a coherent jet for the length of the jet.

The gas passage 60 within lance 1 communicates with a source of gas enabling the gas to flow into and through the gas passage and out from lance 1 at the lance face 5 through gas opening 11 to form the gas stream. Also on lance face 5 is powder mixture opening 20. A powder mixture passage 66 within lance 1 communicates with a source of powder mixture and enables the powder mixture to flow through the powder mixture passage and out from lance 1 at lance face 5 through powder mixture opening 20 to form the powder mixture stream 67. Both the gas stream 62 and the powder mixture stream 67 are contained within the flame envelope 63 generated by the combusting gaseous fuel and oxidant. The gas stream 62 and the powder mixture stream 67 preferably continue as distinct streams until they each impact the target, e.g. the liquid surface.

The centerpoint of the gas opening 11 may coincide with the centerpoint of the lance face 5. Preferably, however, the gas opening 11 is offset on the lance face 5 so that the gas opening is entirely within one half circle of the lance face, i.e., the perimeter of the gas opening either passes through the lance face centerpoint or is entirely between the lance face centerpoint and the lance face perimeter. This latter arrangement is illustrated in FIG. 1. The powder mixture opening is spaced from the gas opening on the lance face. By "spaced" it is meant either having a perimeter adjacent to or a distance, such as distance L shown in FIG. 1, from the perimeter of the gas opening.

FIG. 2 illustrates one preferred arrangement for providing the powder mixture to the lance. The flame shroud holes shown in FIG. 1 are not shown in FIG. 2. Referring now to FIG. 2, a mixture 40 of powder and carrier gas is provided into inner tube 41. The powder is typically taken from a hopper or other storage means and is motivated by a relatively small amount of carrier gas, typically about 200 cubic feet per hour (cfh at 60° F. and 1 atmosphere). The carrier gas is preferably nitrogen gas or air but can be another gas or gas mixture such as oxygen, methane, natural gas, helium, carbon dioxide or argon.

Among the many powders which may be used in the practice of this invention one can name carbonaceous materials such as carbon, coal and coke, silica, magnesia, calcium carbide, calcium carbonates, calcium oxides (lime), furnace dusts and powdered ores.

Additional carrier gas 42, which is preferably the same as the gas employed as the carrier gas in stream 40, preferably is provided to outer tube 43, into which inner tube 41 opens, as accelerating gas to accelerate the powder mixture. Outer tube 43 communicates with the powder mixture passage 66 of the lance 1 through which the powder mixture stream flows for ultimate ejection from the lance through the powder mixture opening 20.

The following test results are provided to further exemplify the invention. The examples and comparative examples are presented for illustrative purposes and not intended to be limiting. The examples of the invention were carried out using equipment similar to that illustrated in FIGS. 1 and 2. The nozzle for the gas was a converging/diverging nozzle with a throat diameter of 0.55 inch and an exit diameter at the gas opening of 0.79 inch. The gas opening centerpoint was spaced 0.875 inch from the lance face centerpoint and the powder mixture opening centerpoint was the same as the lance face centerpoint. The gas was gaseous oxygen having an oxygen concentration of about 100 mole percent and was ejected from the lance through the gas opening at a flowrate of 40,000 cubic feet per hour (CFH) at a supply pressure of 150 pounds per square inch gauge (psig) to form the gas stream as a coherent gas jet. The gaseous fuel was natural gas delivered through the more inner ring of 16 holes, each having a diameter of 0.154 inch on a 2.5 inch diameter circle on the lance face at a flowrate of 5000 cfh. The oxidant which combusts with the gaseous fuel to form the flame envelope was a fluid having an oxygen concentration of about 100 mole percent and was delivered through the more outer ring of 16 holes, each having a diameter of 0.199 inch on a 3.0 inch diameter circle on the lance face at a flowrate of 4000 cfh. The lance also had a 2 inch long extension 68 at its periphery to shield the gases upon their ejection from the lance. The coherent gas jet had a supersonic velocity of about 1700 feet per second. The perimeter of the gas opening was spaced 0.08 inch from the perimeter of the powder mixture opening. The diameter of the gas opening was 0.79 inch and the diameter of the powder mixture opening was 0.805 inch. The powder for this test was crushed walnut shells and the carrier gas and the additional carrier gas used as accelerating gas were both nitrogen gas. The powder was provided at a flow of about 15 pounds per minute.

Figure 4:
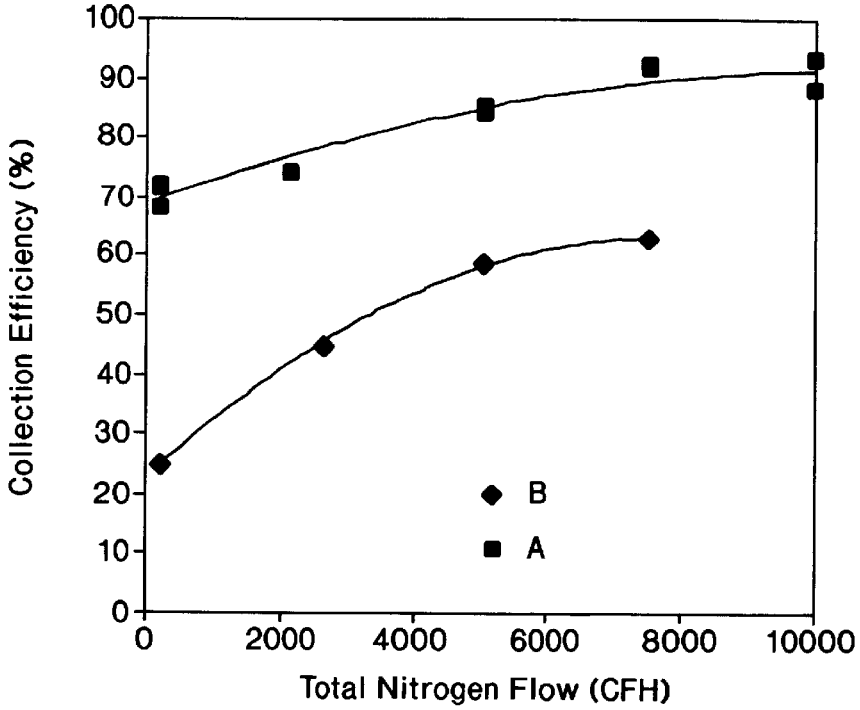
FIG. 4 is a graphical representation of test results generated in examples of the invention and in comparative examples.

In order to measure the capability of the powder delivery, a collector having an 8-inch diameter opening was placed 4 feet from the lance face and the collection efficiency (the ratio of the amount of powder collected to the amount ejected) was measured for various flowrates of the total nitrogen gas and the results are shown in FIG. 4 as curve A. In FIG. 4 the collection efficiency is measured on the vertical axis and the total nitrogen gas flowrate is measured on the horizontal axis.

For comparative purposes a conventional powder injection arrangement was used in conjunction with a coherent jet lance wherein the power injector nozzle was spaced 11 inches from the coherent jet nozzle at an angle of 11.4 degrees so that the coherent jet and the powder mixture stream converged right before the mouth of the collector. In this comparative example the powder flow rate was 11 pounds per minute, the gas opening was centered on the coherent jet lance face, and the natural gas and oxidant ring of holes on the coherent jet lance face were on 2.0 inch and 2.75 inch diameter circles respectively. The collection efficiency was measured for various accelerating gas flowrates and the results reported in FIG. 4 as curve B. As can be seen from these test results, the invention enables a significantly greater percentage of powder to be effectively delivered to a target than is possible with the conventional practice.

Although the invention has been described in detail with reference to certain preferred embodiments, those skilled in the art will recognize that there are other embodiments of the invention within the spirit and the scope of the claims.

What is claimed is:

1. A method for delivering both powder and gas to a liquid comprising:

(A) ejecting gas from a lance through a gas opening on the face of the lance to form a gas stream;

(B) ejecting a mixture of powder and carrier gas from the lance through a powder mixture opening on the face of the lance, said powder mixture opening being spaced from the gas opening, to form a powder mixture stream;

(C) forming a flame envelope around both the gas stream and the powder mixture stream; and (D) passing the gas stream and the powder mixture stream from the lance face to the liquid.

2. The method of claim 1 wherein the gas stream and the powder mixture stream remain distinct streams from the lance face to the liquid.

3. The method of claim 1 wherein the flame envelope is formed by providing gaseous fuel and oxidant in separate annular streams out from the lance face and thereafter combusting the gaseous fuel and oxidant.

4. The method of claim 1 wherein the gas is gaseous oxygen.

5. The method of claim 1 wherein the gas stream has a supersonic velocity from the lance face to the liquid.

6. The method of claim 1 wherein the powder comprises carbonaceous material.

7. The method of claim 1 wherein the carrier gas is nitrogen gas.

8. Apparatus for providing both powder and gas to a liquid comprising:

(A) a lance having a lance face;

(B) a gas passage within the lance, said gas passage communicating with a source of gas and also communicating with a gas opening on the lance face;

(C) a powder mixture passage within the lance, said powder mixture passage communicating with a source of powder and carrier gas and also communicating with a powder mixture opening on the lance face, said powder mixture opening being spaced from the gas opening; and (D) means for providing gaseous fuel and oxidant out from the lance in a ring around the gas opening and the powder mixture opening.

9. The apparatus of claim 8 wherein the gas passage comprises a converging/diverging nozzle.

* * * * *